US006850158B1

(12) United States Patent
Williams

(10) Patent No.: US 6,850,158 B1
(45) Date of Patent: Feb. 1, 2005

(54) KEY LOCATING SYSTEM

(76) Inventor: Judy L. Williams, 428 Colonia Ter., Hopkinsville, KY (US) 42240

( * ) Notice: Subject to any disclaimer, the term of this patent is extended or adjusted under 35 U.S.C. 154(b) by 0 days.

(21) Appl. No.: 10/384,146

(22) Filed: Mar. 10, 2003

(51) Int. Cl.[7] ..... G08B 1/08

(52) U.S. Cl. ..... 340/539.11; 340/571; 340/693.5; 340/568.1

(58) Field of Search ..... 340/571, 539.11, 340/693.5, 568.1, 5.1, 5.22, 505, 573.1, 10.1, 573.4

(56) References Cited

U.S. PATENT DOCUMENTS 4,673,915 A 6/1987 Cobb
5,677,673 A * 10/1997 Kipnis ..... 340/539.32
5,680,105 A 10/1997 Hedrick
D392,201 S 3/1998 Chen
5,939,981 A 8/1999 Renney
6,297,737 B1 10/2001 Irvin
6,331,817 B1 12/2001 Goldberg
6,366,202 B1 * 4/2002 Rosenthal ..... 340/539.32
6,462,658 B1 * 10/2002 Bender ..... 340/568.1
6,501,378 B1 * 12/2002 Knaven ..... 340/539.1
2002/0044055 A1 * 4/2002 Maloney ..... 340/571

* cited by examiner

*Primary Examiner*—Anh V. La

(57) ABSTRACT

A key locating system for includes a base unit including a housing having a back wall, a front wall and a peripheral wall extending between the front and back walls. The front wall has a plurality of docking stations therein. A plurality of actuators is mounted on the front wall. Each of the actuators is relatively adjacent to one of the docking stations and is operationally coupled thereto. Each of a plurality transmitters is adapted for transmitting a different wireless signal. Each of the transmitters includes a second mating member adapted for coupling with one of the first mating members. Each of a plurality of receiving devices is adapted for receiving a wireless signal transmitted from a corresponding one of the transmitters.

1 Claim, 5 Drawing Sheets

KEY LOCATING SYSTEM

BACKGROUND OF THE INVENTION

1. Field of the Invention

The present invention relates to key finding devices and more particularly pertains to a new key finding device for providing a user with a transmitter to send signals to multiple key ring mountable receiving devices which emit audible tones when their particular signal is received.

2. Description of the Prior Art

The use of key finding devices is known in the prior art. U.S. Pat. No. 5,939,981 describes a device for locating pre-selected items. Another type of key finding device is U.S. Pat. No. 6,331,817 which describes an object tracking apparatus and method. U.S. Pat. No. 6,297,737 describes an object locating system utilizing a wireless communication interface for transmitting signals to one or more locating tags.

While these devices fulfill their respective, particular objectives and requirements, the need remains for a device that allows for the location of multiple items, particular sets of keys, from a single base unit.

SUMMARY OF THE INVENTION

The present invention meets the needs presented above by providing a wall mountable base unit that stores multiple locating devices.

Another object of the present invention is to provide a new key finding device that includes a portable transmitting unit which can be used to located items beyond the range of the base unit.

Still another object of the present invention is to provide a new key finding device that can be used for other items besides keys, such as remote controls, personal organizers or other commonly misplaced items.

To this end, the present invention generally comprises a base unit including a housing having a back wall, a front wall and a peripheral wall extending between the front and back walls. The front wall has a plurality of docking stations therein. A plurality of actuators is mounted on the front wall. Each of the actuators is relatively adjacent to one of the docking stations and is operationally coupled thereto. Each of a plurality transmitters is adapted for transmitting a different wireless signal. Each of the transmitters includes a second mating member adapted for coupling with one of the first mating members. Each of a plurality of receiving devices is adapted for receiving a wireless signal transmitted from a corresponding one of the transmitters.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
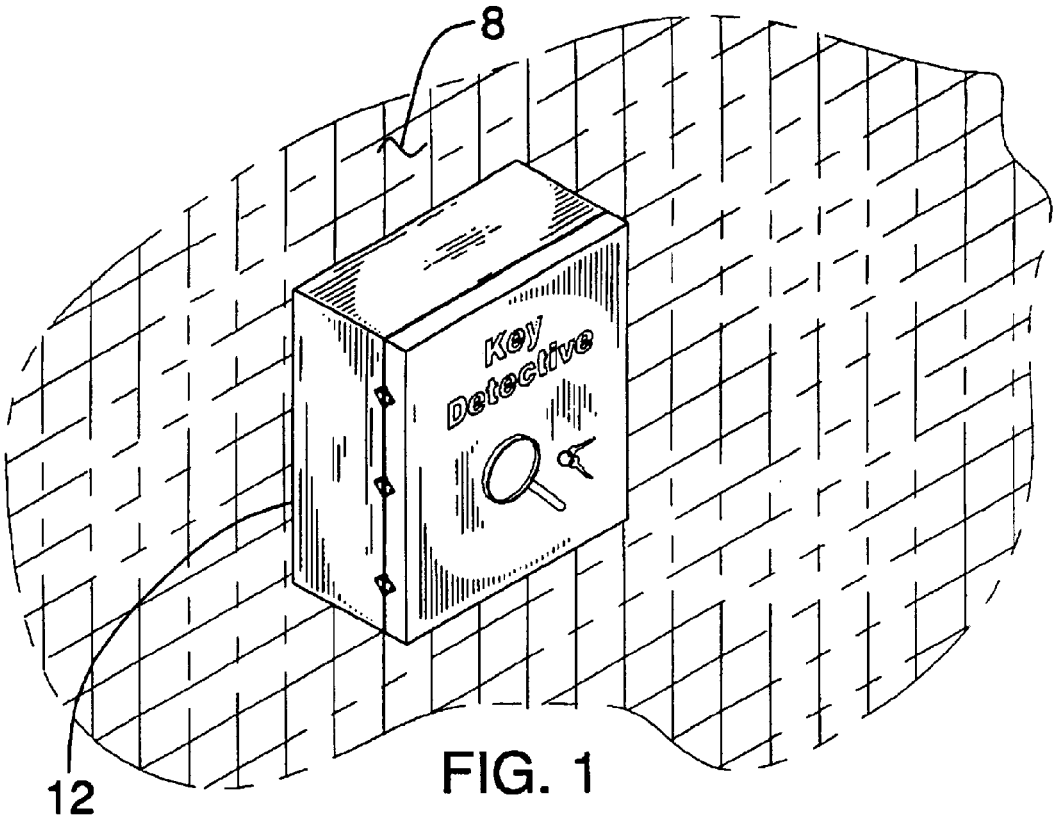
FIG. 1 is a schematic perspective view of a key locating system according to the present invention.
Figure 2:
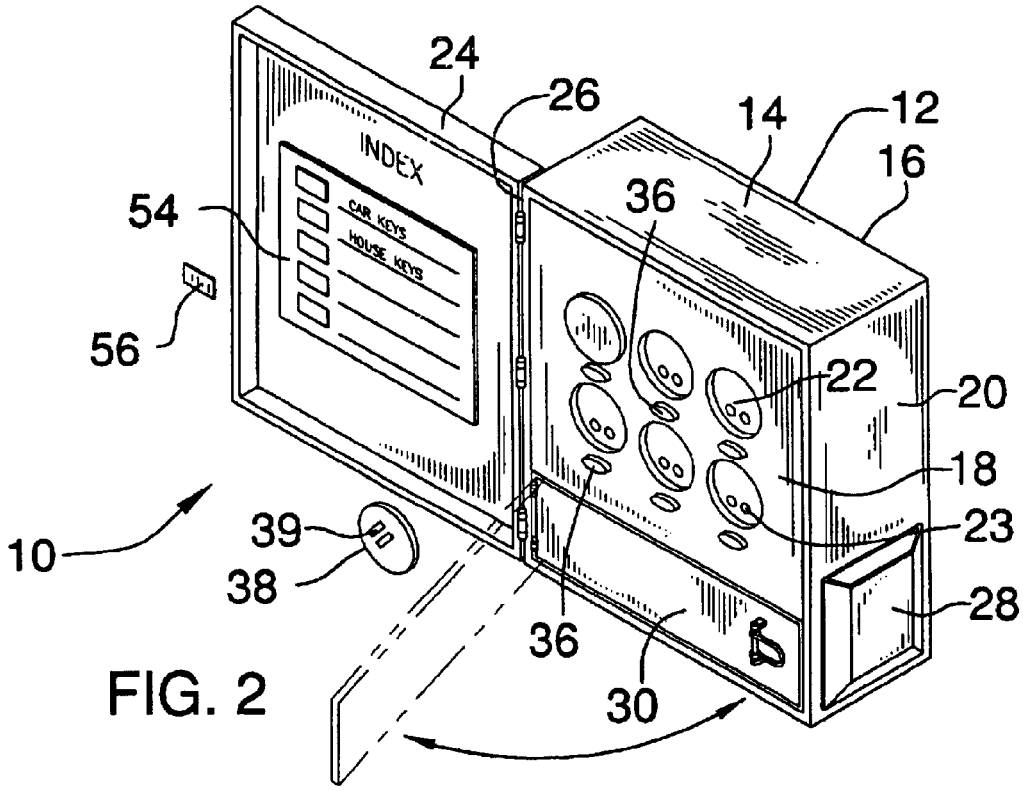
FIG. 2 is a schematic perspective view of the present invention.
Figure 3:
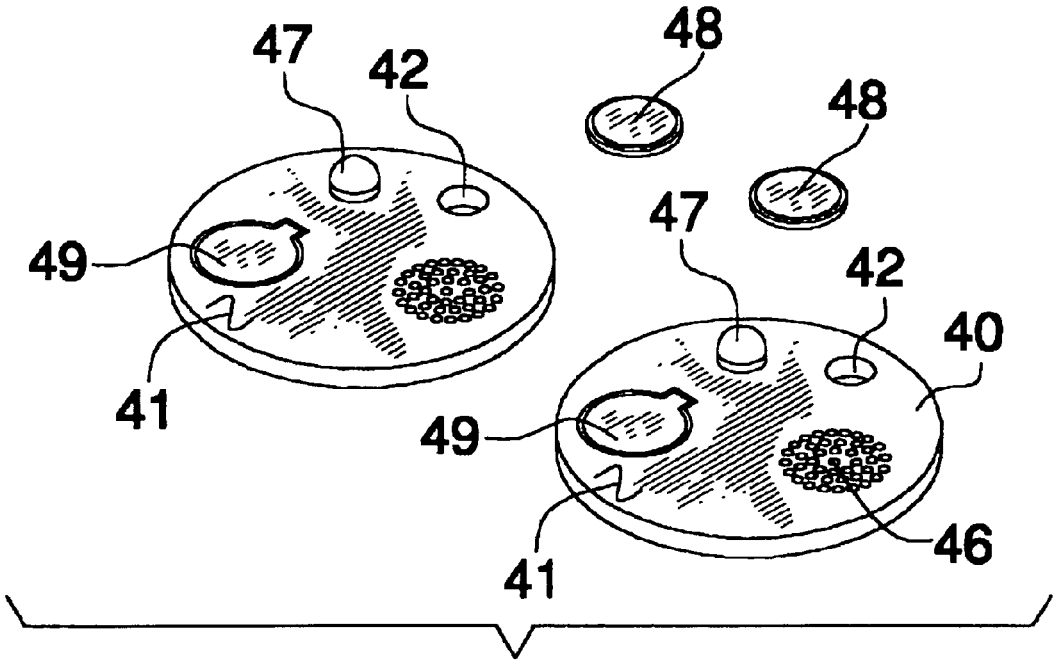
FIG. 3 is a schematic perspective view of the receiving devices of the present invention.
Figure 4:
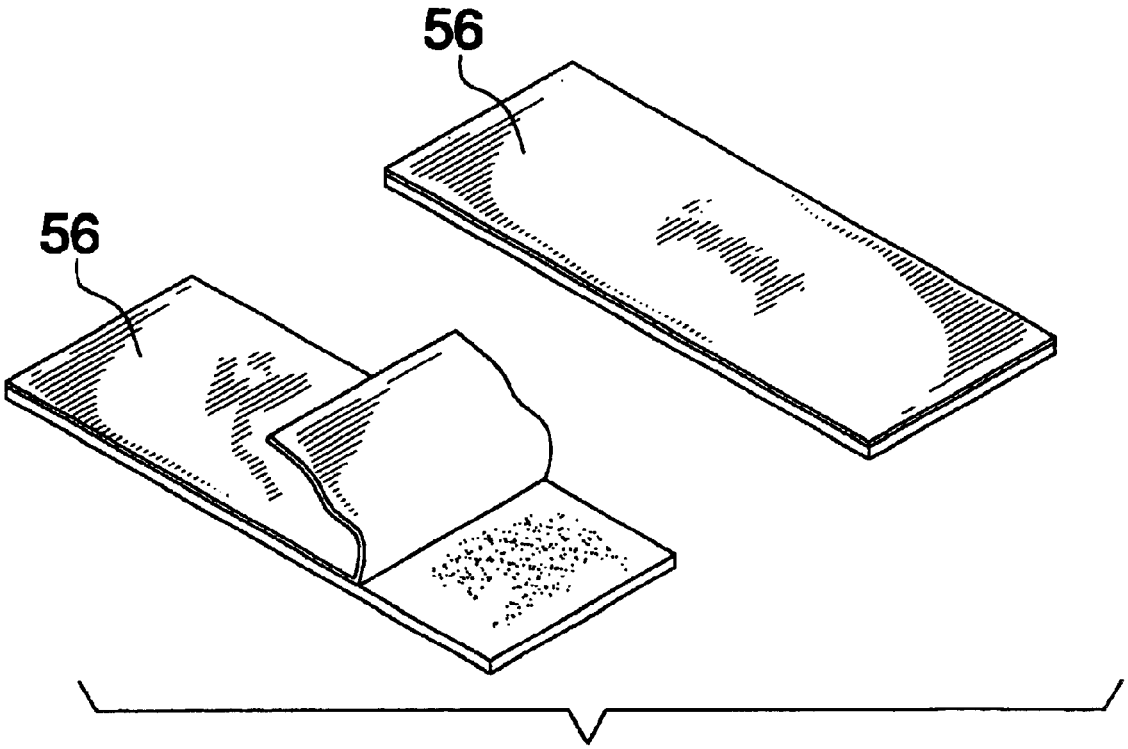
FIG. 4 is a schematic perspective view of the labels of the present invention.
Figure 5:
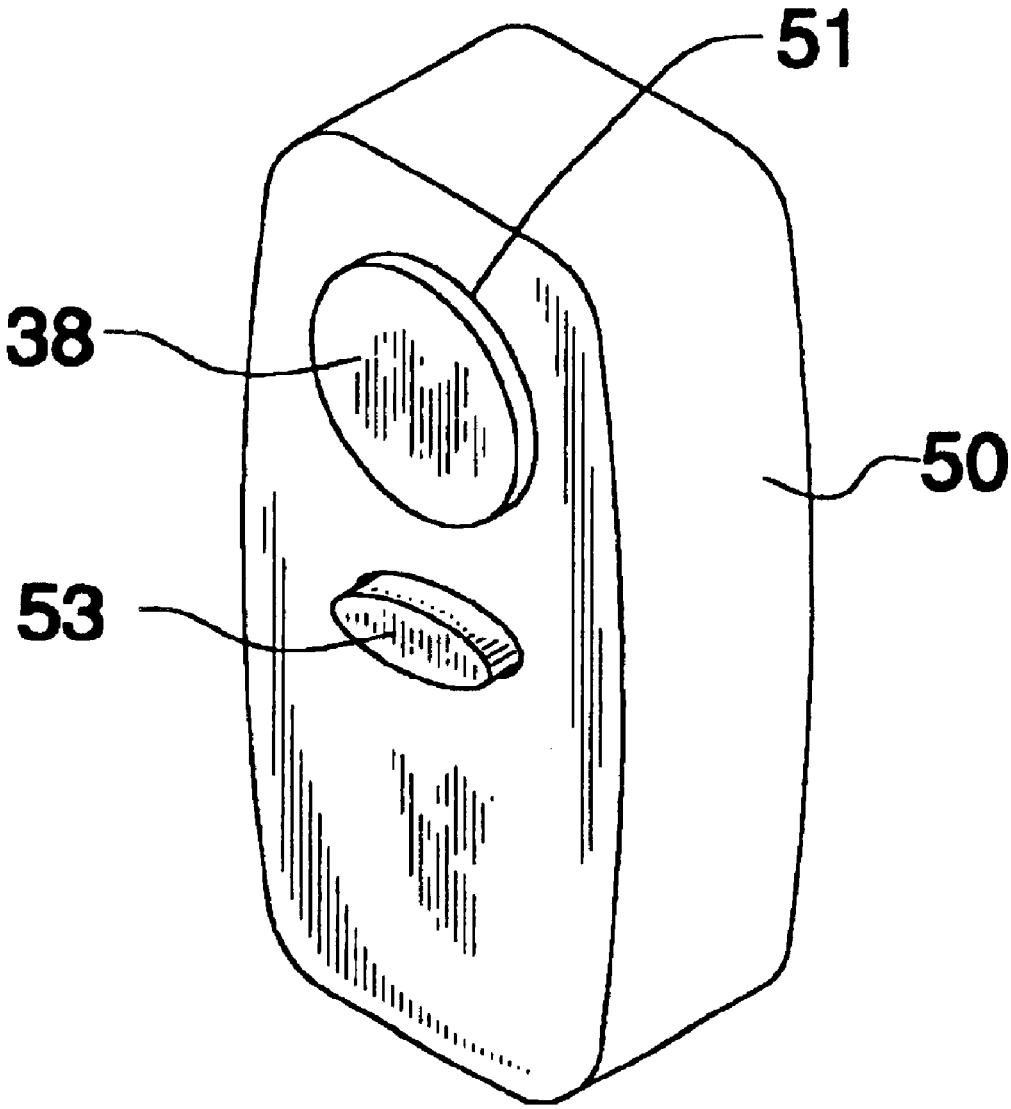
FIG. 5 is a schematic perspective view of the mobile transmitter unit of present invention.
Figure 6:
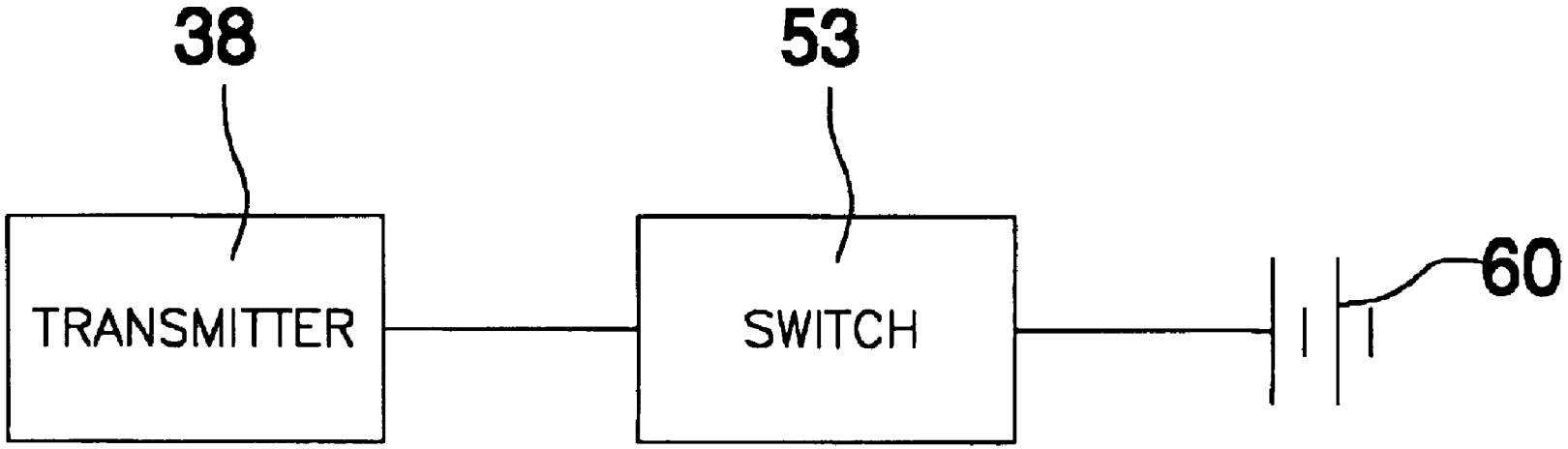
FIG. 6 is an electronic schematic view of the present invention.
Figure 7:
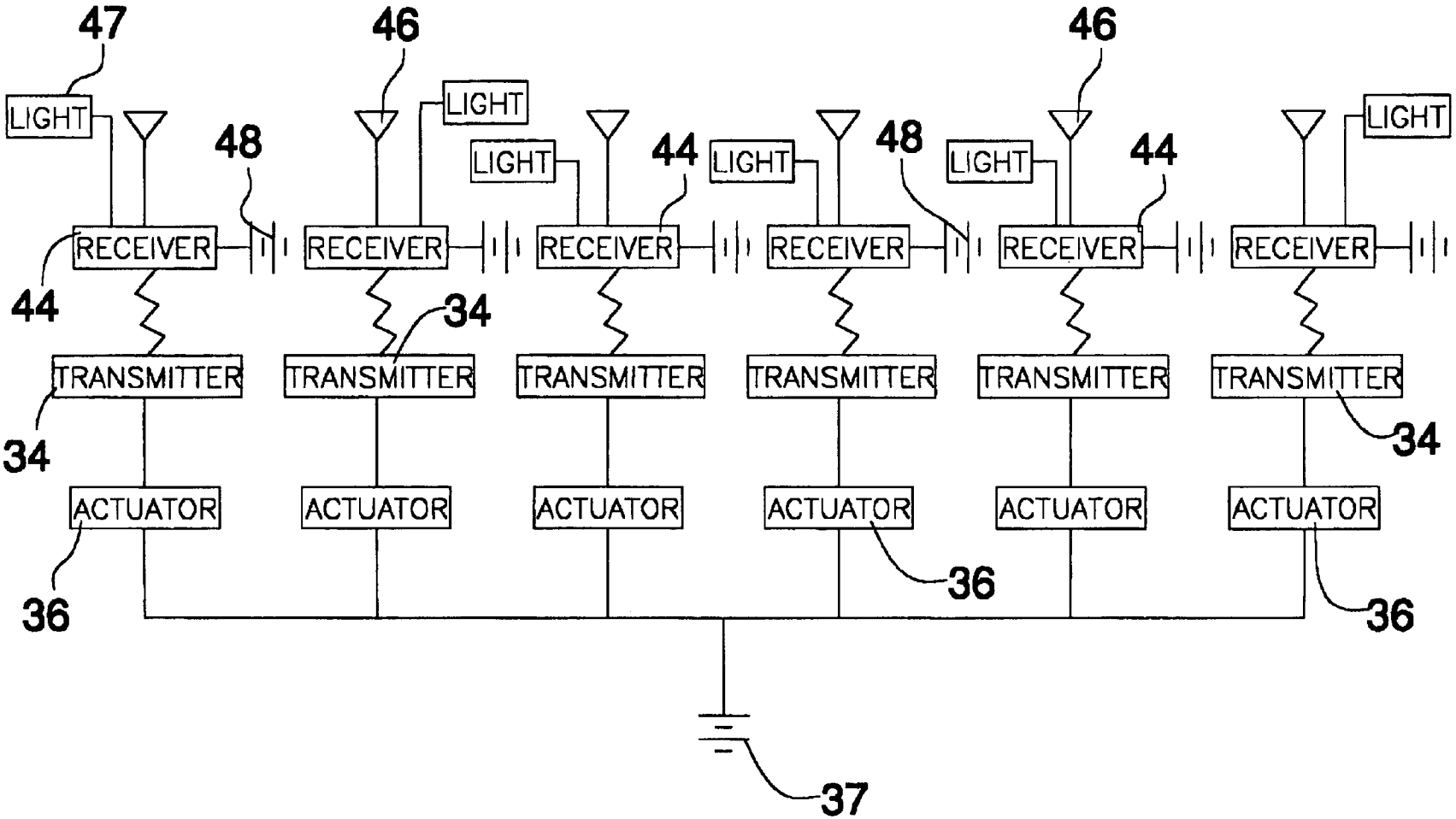
FIG. 7 is an electronic schematic view of the mobile transmitter unit of the present invention.

With reference now to the drawings, and in particular to FIGS. 1 through 7 thereof, a new key finding device embodying the principles and concepts of the present invention and generally designated by the reference numeral 10 will be described.

As best illustrated in FIGS. 1 through 7, the key locating system 10 generally comprises a base unit including a housing 14 having a back wall 16, a front wall 18 and a peripheral wall 20 extending between the front 18 and back 16 walls. The front wall 18 has a plurality of docking stations 22 therein. Each of the docking stations 22 is preferably formed by a depression in the front wall 18. The docking stations 22 each have a first mating member mounting 23 therein. A door 24 is hingedly attached to an outer edge 26 of the peripheral wall 20 for selectively positioning in a closed position extending over the front wall 18 or an open position away from the front wall 18. Preferably, a compartment 28 is mounted on the peripheral wall for holding a variety of items including writing utensils and the like. A plurality of actuators 36 is mounted on the front wall 18. Each of the actuators 36 is relatively adjacent to one of the docking stations 22 and is operationally coupled thereto. A power supply 37 is electrically coupled to each of the actuators 36. The power supply 37 is preferably one or more batteries positioned within the housing 14. A compartment door 30 is preferably positioned in the front wall 22 for removing or changing batteries positioned within the housing 14.

Each of a plurality of transmitters 38 is adapted for transmitting a different wireless signal. The wireless signal is preferably a radio signal. Each of the transmitters 38 includes a second mating member 39 adapted for coupling with one of the first mating members 23. The first 23 and second 39 mating members may be any conventional male/female mating pair adapted for exchanging an electronic signal. The transmitters 38 have a size and shape adapted for positioning in one of the docking stations 22. Ideally, each of the transmitters 38 has a different color.

Each of a plurality of receiving devices 40 is adapted for receiving a wireless signal transmitted from a corresponding one of the transmitters 38. Each of the receiving devices 40 includes a casing 41 having a color corresponding to a color of the corresponding one of the transmitters 38. By this method, the transmitters 38 and the receiving devices 40 are color coded to match each other as an easy visual cue for the user of the system 10. Alternate methods, such as indicia placed on the receiving devices 40 and transmitters 38, may also be used. The casing 41 has an aperture 42 extending therethrough for receiving a key chain. Preferably, the casing 41 has the same size as the depression of the docking station 22 for easy fitting of the casing 41 in the docking station 22. A receiver 44 is mounted in the casing 41 and is adapted for receiving one of the signals transmitted by the transmitters 38. A sound emitter 46 for emitting an audible sound is mounted in the casing 41 and is operationally coupled to the receiver 44. The sound emitter 46 emits a sound when the receiver 44 receives a signal. A light emitter 47 is mounted on the casing 41 and is operationally coupled to the receiver 44. The light emitter 47, preferably a LED, is turned on when the receiver 44 receives a signal. A power supply 48, which is preferably a battery, is removably mounted in the casing 41 behind a removable door 49.

A mobile transmitting unit 50 includes a single docking station 51 for removably receiving one of the transmitters 38. The mobile transmitting unit 50 is a mobile version of the base unit, except, preferably, on a much smaller scale. The single docking station 51 includes a first mating member, not shown but identical to the first mating members 23 positioned in the base unit 12. A switch 53, or actuator, is electrically coupled to the single docking station 51 for activating a transmitter 38 when such is coupled to the single docking station 51. A power supply 60 is electrically coupled to the single docking station 51.

In use, the base unit 12 is attached to a wall surface 8 using conventional mechanical fasteners. A user of the system 10 attaches a first one of the receiving devices 40 to a key ring or to any other item which the user would like to track, such as a remote control, day planner or other often misplaced item. The first receiving device 40 is colored a color corresponding to a first one of the transmitters 38. The color indicates to the user that the first transmitter 38 transmits a signal which is receivable by, and unique to, the first receiving device 40. The first transmitter 38 is positioned in a docking station 22 so that the first 23 and second 39 mating members are coupled together. The actuator 36 adjacent to the docking station 22 containing the first transmitter 38 is depressed so that the first transmitter 38 emits a first signal. When the first receiving device 40 receives the first signal, the sound emitter 46 emits an audible sound and the light emitter 47 emits a light to aid the user in finding the item to which the first receiving device 40 is attached. The same process may be done with the other transmitters 38 and their corresponding receiving devices 40. The mobile transmitting unit 50 is used when the receiving device 40 being signaled is outside of the range of the transmitter 38 when it is placed in the base unit 12.

Additional elements of the system 10 include an index 54 and labels 56. The index 54 is positioned on an inner surface of the door 24 of the housing 14 so that the user may list each of the items to which a receiving device 40 is attached. The labels 56 are each colored a color corresponding to the transmitters. The user places the label 56 adjacent to each of the names of the items on the index 54 to indicate to the user the appropriate actuator 36 to depress. The labels preferably have an adhesive thereon for aiding in their attachment to the index 54.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tracking system for tracking a plurality of sets of keys, said system including:

a base unit including a housing having a back wall, a front wall and a peripheral wall extending between said front and back walls, said front wall having a plurality of docking stations therein, each of said docking stations including a first mating member, a door being hingedly attached to an outer edge of said peripheral wall for selectively positioning in a closed position extending over said front wall or an open position away from said front wall;

a plurality of actuators being mounted on said front wall, each of said actuators being relatively adjacent to one of said docking stations and being operationally coupled thereto, a power supply being electrically coupled to each of said actuators;

a plurality of transmitters, each of said transmitters being adapted for transmitting a different wireless signal, each of said transmitters including a second mating member adapted for coupling with one of said first mating members, each of said transmitters having a size and shape adapted for positioning in one of said docking stations, each of said transmitters having a different color;

a plurality of receiving devices, each of said receiving devices being adapted for receiving a wireless signal transmitted from a corresponding one of said transmitters, each of said receiving devices including;

a casing having a color corresponding to a color of said corresponding one of said transmitters, said casing having an aperture extending therethrough;

a receiver being mounted in said casing and adapted for receiving one of said signals transmitted by said transmitters;

a sound emitter for emitting an audible sound being mounted in said casing and being operationally coupled to said receiver, wherein said sound emitter emits a sound when said receiver receives a signal;

a light emitter being mounted on said casing and being operationally coupled to said receiver, wherein said light emitter is turned on when said receiver receives a signal;

a power supply being mounted in said casing; and a mobile transmitting unit including a single docking station for removably receiving one of said transmitters, said single docking station including a first mating member, a switch being electrically coupled to said single docking station, a power supply being electrically coupled to said single docking station.

* * * * *